United States Patent [19]

Jarvis et al.

[11] Patent Number: 4,991,611

[45] Date of Patent: Feb. 12, 1991

[54] LOWER SPRAY ARM FOR DISHWASHER

[75] Inventors: Wilbur W. Jarvis, St. Joseph Township, Berrien County; John I. Smith, Coloma Township, Berrien County, both of Mich.; Kirk A. Gutmann, Perry Township, Allen County, Ind.; Lane S. Duncan, Independence, Ohio; Richard D. Taylor, Harrison Township, Bartholomew County, Ind.; Richard W. Germuska, Brunswick, Ohio

[73] Assignee: Whirlpool Corporation, Benton Harbor, Mich.

[21] Appl. No.: 363,614

[22] Filed: Jun. 8, 1989

[51] Int. Cl.[5] ..... A47L 15/23

[52] U.S. Cl. ..... 134/179; 239/206; 239/261

[58] Field of Search ..... 134/176, 179; 239/206, 239/261, 264

[56] References Cited

U.S. PATENT DOCUMENTS

| | | | |
|---|---|---|---|
| 3,077,200 | 2/1963 | Guth | 134/176 |
| 3,288,156 | 11/1966 | Jordan et al. | 134/176 |
| 3,292,645 | 12/1966 | Braden et al. | 134/176 X |
| 3,375,835 | 4/1968 | Lopp et al. | 134/176 |
| 3,841,342 | 10/1974 | Cushing et al. | 134/176 X |
| 3,866,837 | 2/1975 | Jenkins | 134/176 X |
| 3,989,054 | 11/1976 | Mercer | 134/176 X |
| 4,175,575 | 11/1979 | Cushing | 134/176 |

FOREIGN PATENT DOCUMENTS

| | | | |
|---|---|---|---|
| 1628601 | 8/1970 | Fed. Rep. of Germany | 134/176 |

*Primary Examiner*—Philip R. Coe

*Attorney, Agent, or Firm*—Wood, Phillips, Mason, Recktenwald & Vansanten

[57] ABSTRACT

A spray arm assembly for delivering a fluid under pressure into a dishwasher wash chamber consists of a spray arm having a rotational axis and defining a fluid passageway for distributing incoming fluid into the wash chamber, a tower section, structure for mounting the tower section to the spray arm for guided movement relative to the spray arm between a retracted position and an extended position, and structure on the tower section for directing fluid from the fluid supply into the wash chamber with the lower section in its extended position. Mounting structure, integrally formed with the spray arm, prevents the tower section from separating from the spray arm with the tower section in its extended position. Any number of cooperating tower sections can be employed.

14 Claims, 3 Drawing Sheets

LOWER SPRAY ARM FOR DISHWASHER

BACKGROUND OF THE INVENTION

1. Field of the Invention

The present invention relates to spray arms for distributing fluid from a pressurized supply into a dishwasher wash chamber and, more particularly, to a spray arm with a telescoping spray tower and a method of forming the same.

2. Description of the Prior Art

It is known to provide one or more extensible spray tower sections on a rotary dishwasher spray arm to enhance the distribution of water from a pressurized fluid supply in a wash chamber. One exemplary prior art structure is shown in U.S. Pat. No. 3,866,837, to Jenkins. In Jenkins '837, a spray tower is inserted, during the assembly process, through an opening in the top of the spray arm. Subsequent to the placement of the spray tower in the spray arm opening, a retainer cap is threaded onto the spray arm to prevent separation of the tower from the spray arm.

One drawback with the Jenkins '837 structure is that there is a potential leak point for incoming fluid between the retainer cap and the spray arm, which may diminish the pressure of the fluid in the tower.

A further drawback with the structure in Jenkins '837 is that the entire spray arm assembly is relatively complicated from a manufacturing standpoint.

SUMMARY OF THE INVENTION

The present invention is specifically directed to overcoming the above enumerated problems in a novel and simple manner.

According to the invention, a spray arm assembly for delivering a fluid under pressure into a dishwasher wash chamber consists of a spray arm having a rotational axis and defining a fluid passageway for distributing incoming fluid into the wash chamber, a tower section, structure for mounting the tower section to the spray arm for guided movement relative to the spray arm between a retracted position and an extended position, and structure on the tower section for directing fluid from the fluid supply into the wash chamber with the tower section in its extended position. Mounting structure, integrally formed with the spray arm, prevents the tower section from separating from the spray arm with the tower section in its extended position. Any number of cooperating tower sections can be employed.

With the inventive structure, the spray arm and tower can be preassembled as an inseparable, operative assembly. Facilitated connection of the entire spray arm assembly to the remainder of the dishwasher results.

In a preferred form of the invention, the spray arm is defined by at least two permanently fused spray arm sections. There is cooperating structure on the tower section and the two fused spray arm sections to prevent the tower section from separating from the spray arm. In one form of the invention, the tower section has a lip which encounters an integrally formed shoulder on one of the spray arm sections to arrest movement of the tower section relative to the one spray arm section in one direction and the lip abuts a wall spaced from the shoulder and integrally formed with the other spray arm section to limit movement of the tower section relative to the spray arm in a direction opposite the one direction.

The invention also comprehends a method of forming the spray arm assembly. First and second separate, joinable spray arm sections are provided. One of the spray arm sections has an opening to receive the tower section, which is directed through the opening prior to the connection of the spray arm sections to each other.

Preferably, the spray arm section with the tower receiving opening is inverted and the tower section is directed through the opening in the section and suspended from the one spray arm section by the lip on the tower section. Fusion of the spray arm sections is carried out with the spray arm inverted.

To facilitate connection of the spray arm assembly to a fluid pump, a support sleeve and nut are provided. The nut surrounds the bottom of the spray arm and is attached thereto from the bottom of the spray arm. The support sleeve is also attached to the spray arm from the bottom thereof and captively maintains the nut against the spray arm in operative position wherein it is used to secure the support sleeve and the attached spray arm to the fluid pump.

With this arrangement, the nut and support sleeve can be attached to the spray arm assembly from one side and the securing of the support sleeve to the spray arm can be accomplished from the same side, as by a screw. This arrangement facilitates automated assembly of the spray arm assembly, the support sleeve and nut.

Preferably, the support sleeve and screw are preassembled using a retaining washer. A bearing is placed between the screw and support sleeve. The retaining washer also maintains a slight spacing between the assembled support sleeve and spray arm to permit free relative rotation therebetween.

A sealing ring is provided and situated between the spray arm and the subassembly, consisting of the support sleeve, screw and bearing, and blocks passage of fluid between the spray arm and support sleeve subassembly.

DETAILED DESCRIPTION OF THE DRAWINGS

Figure 1:
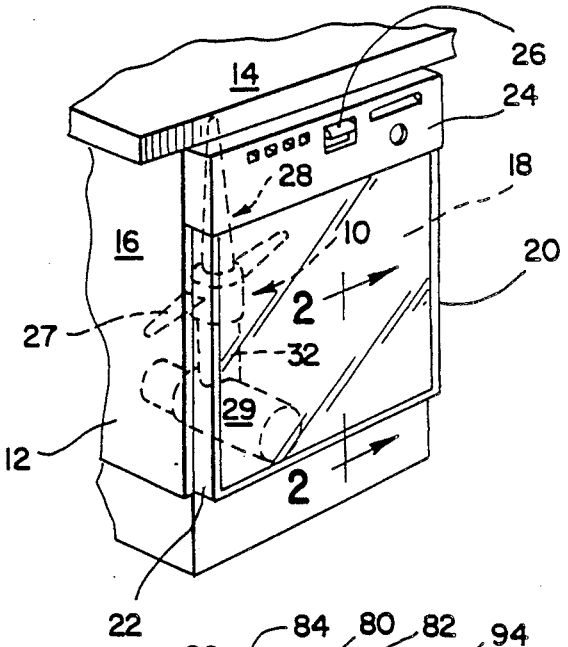
FIG. 1 is a perspective view of a dishwasher having a preferred form of spray arm assembly according to the present invention incorporated therein.

In FIG. 1, a spray arm assembly, according to the present invention, is shown at 10 incorporated into a dishwasher 12 shown mounted under a counter 14. The dishwasher 12 is only intended to be representative of one type of dishwasher into which the inventive spray arm assembly 10 can be incorporated.

The dishwasher 12 has a cabinet 16 defining a wash chamber 18 within which dishes and utensils ar supported on racks (not shown) for treatment. The wash chamber 18 is selectively sealed by a hinged door 20, which is pivotable about its lower edge 22 between the closed position, shown in FIG. 1, and an open position, wherein access can be gained to the wash chamber 18. A control console 24 is incorporated into the top of the door 20 and has a latch 26 to selectively lock and release the door 20.

The spray arm assembly 10, which includes a spray arm 27 and a tower 28, resides within the wash chamber 18 and during operation distributes a supply of water delivered under pressure by a pump 29 throughout the wash chamber 18. Details of the spray arm assembly 10 are shown clearly in FIGS. 2–5.

The spray arm assembly 10 is supported on a raised pedestal at 30 at the bottom of the wash chamber 18. The pedestal 30 consists of a pump outlet conduit 32 surrounded by a raised portion of a liner 34 which bounds the wash chamber 18. The liner 34 has an opening 36 through which the pump outlet conduit 32 projects. A gasket 38 and a washer 39, vented at 41, together prevent the escape of fluid from the wash chamber 18 around the conduit 32 and underneath the raised portion of the liner 34 where it could potentially come into contact with the pump 29.

The spray arm 27 consists of a cylindrical hub 40 having a vertical rotational axis 42 and integral, radially projecting conduits 44, 46. The hub 40 defines a passageway 48 for communicating fluid under pressure from the pump 29 upwardly and to radially outwardly extending fluid passageways 50, 52, defined by conduits 44, 46 respectively. The conduits 44, 46 have discharge openings 54 for directing the pressurized fluid from the passageways 50, 52 directly into the wash chamber 18.

To further distribute incoming fluid from the pump 29 in the wash chamber 18, the extendable tower 28 is provided in the hollow 48 of the spray arm hub 40. The tower 28 consists of three telescopingly mated, cylindrical, hollow sections 58, 60, 62.

Figure 2:
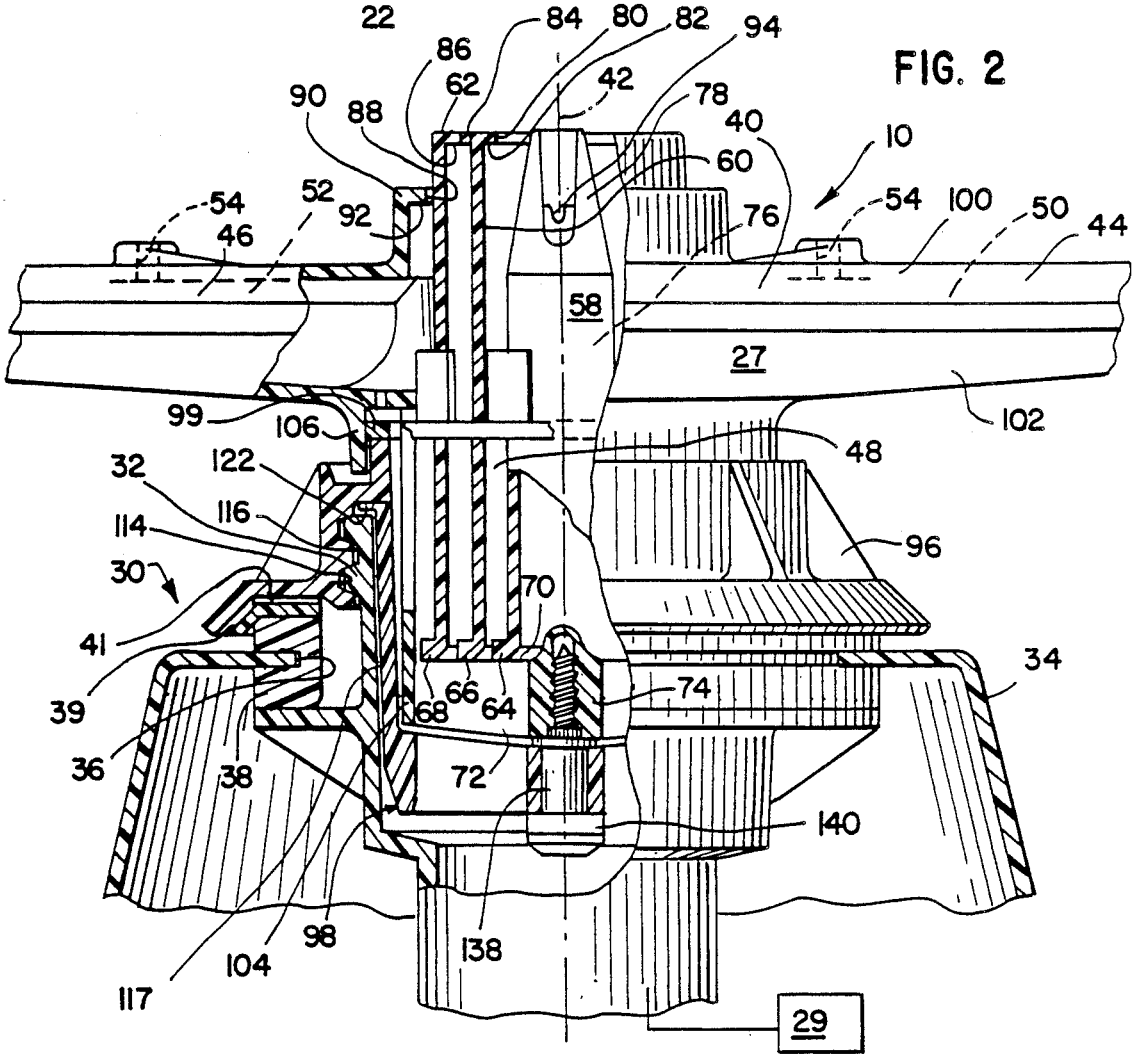
FIG. 2 is an enlarged section view of the spray arm assembly taken along line 2—2 of FIG. 1.
Figure 3:
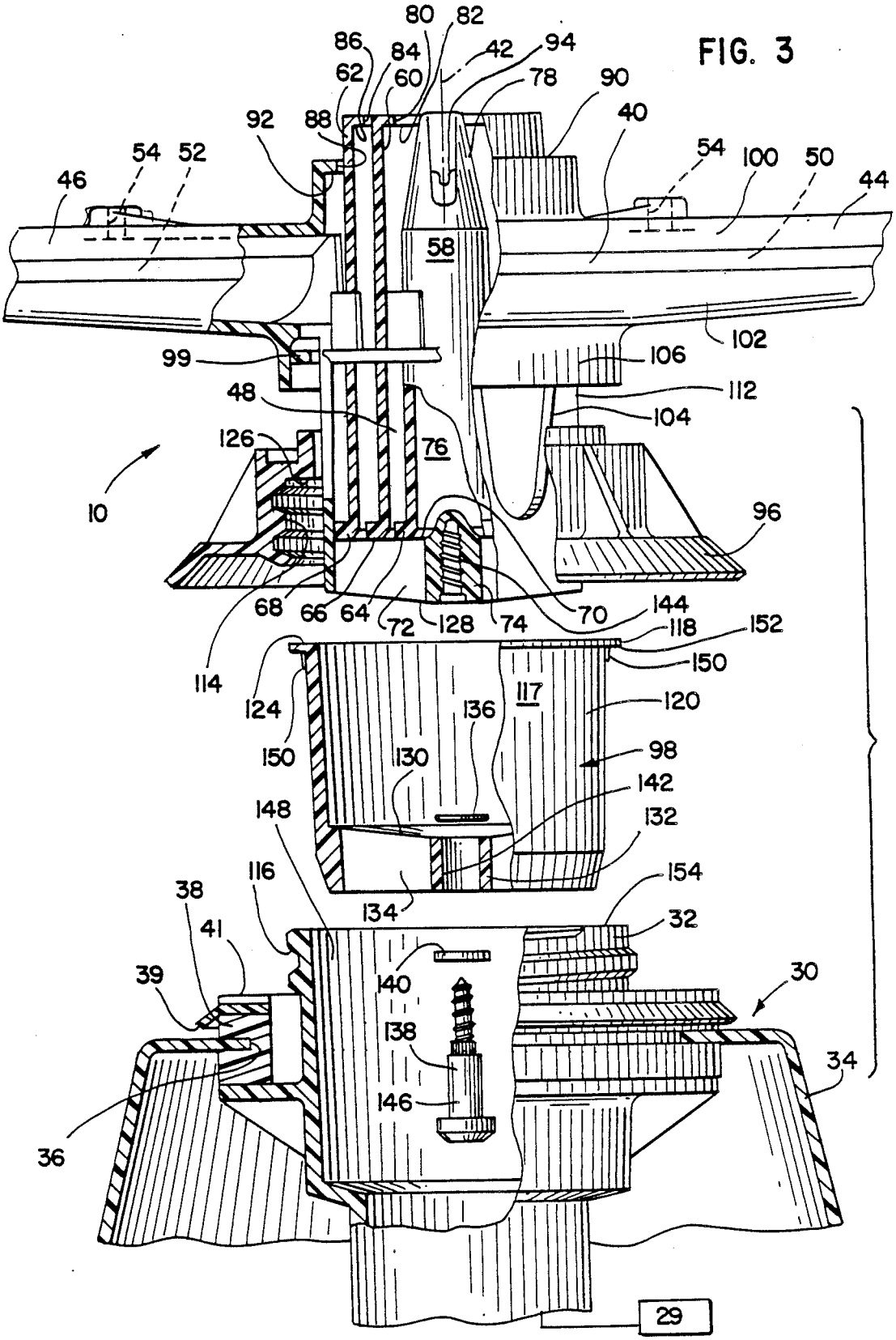
FIG. 3 is an enlarged, exploded view of the spray arm assembly, partially in section.

The tower sections 58, 60, 62 are normally in a collapsed/retracted position, shown in FIGS. 2 and 3. The sections 58, 60, 62 have, at the bottom thereof, radially extending lips 64, 66, 68, consecutively, which are borne by an upwardly facing wall surface 70 defined cooperatively by a plurality of ribs 72 extending radially from a central hub 74 at the bottom of the spray arm 27.

Fluid under pressure from the pump 29 exits the conduit 32 and flows upwardly into the hollow 76 of the radially innermost tower section 58 and impinges against the converging inside surface of the upper end 78 of the tower section 58, thereby causing the tower section 58 to move upwardly guidingly through an opening 80 in the surrounding tower section 60. The lip 64 on tower section 58 has a larger diameter than the opening 80 and, as it rises, comes into contact with a downwardly facing shoulder 82 on the tower section 60 so that continued movement of the tower section 58 unseats the tower section 60. The tower section 60 is free to move upwardly through an opening 84 in the tower section 62 until the lip 66 encounters a downwardly facing shoulder 86 on tower section 62 surrounding the opening 84. The lip 66 in turn draws the tower section 62 upwardly and through an opening 88 in a fixed wall 90 at the top of and integrally formed with the spray arm 27 until the lip 68 abuts a downwardly facing shoulder 92 surrounding the opening 88 and its vertical movement is arrested. In the fully extended tower position, fluid from the pump conduit 32 flows freely consecutively through the conduits 62, 60, 58 and is discharged through openings 94 in the tower 58 into the wash chamber 18.

According to the invention, the spray arm assembly 10 is formed as a self-contained operable unit which is attached to the pump conduit 32 through the use of a nut 96 and support sleeve subassembly 98, and sealed by a split ring 99, as described later herein. The spray arm 27 is formed in two sections—an upper spray arm section 100 and a lower spray arm section 102. The lower spray arm section 102 may be formed in one piece or may be a preassembled subassembly consisting of a cup-shaped tower receptacle 104 defining the wall surface 70 nested in and fused with a depending annular skirt 106 on the lower spray arm section 102.

Figure 4:
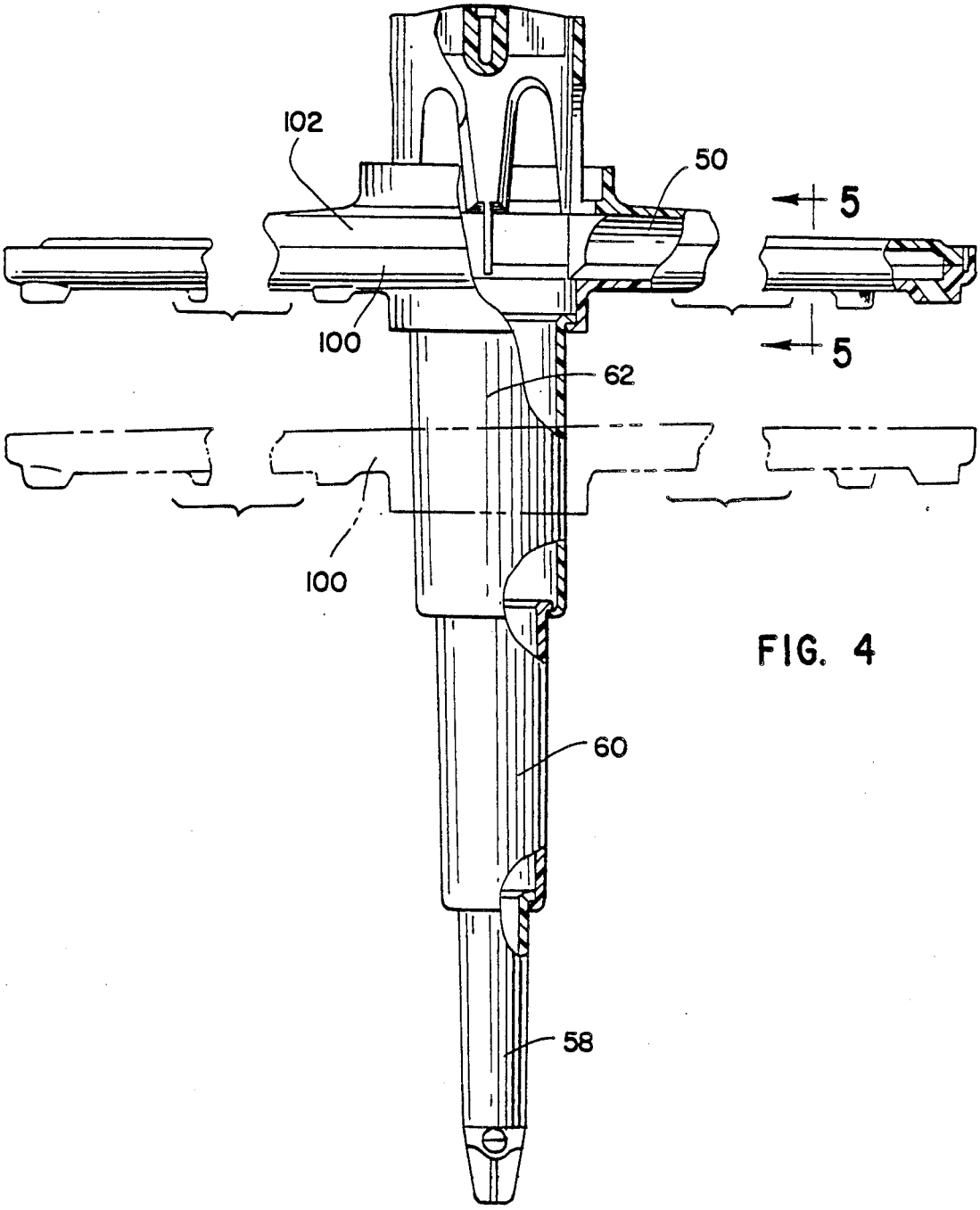
FIG. 4 is an elevation view of the spray arm assembly shown in an inverted position during assembly.
Figure 5:
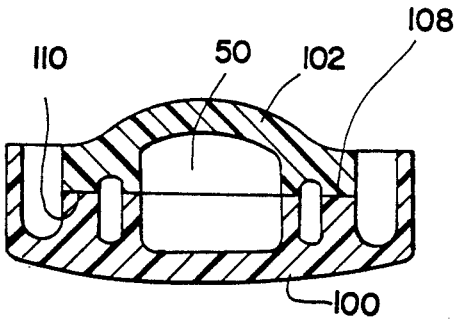
FIG. 5 is an enlarged, section view of the spray arm assembly taken along line 5—5 of FIG. 4.

To assemble the spray arm assembly 10, the tower sections 58, 60, 62 are nested, one within the other, and directed through the opening 88 in the upper spray arm section 100 from the bottom up. This is more readily accomplished with the spray arm section 100 inverted, as shown in FIG. 4, so that the tower sections 58, 60, 62 hang in a fully extended position from the wall 90 of the upper section 100 by their respective lips 64, 66, 68. The upwardly facing edge 108 of the inverted tower section 100 is heat sealed to the downwardly facing edge 110 of the inverted lower support arm section 102 in conventional fashion to fuse the spray arm sections 100, 102 in fluid tight fashion. The fused sections 100, 102 cooperatively bound the fluid passageways 50, 52, as seen clearly in FIG. 5.

With the spray arm sections 100, 102 fused, it can be seen that the tower sections 58, 60, 62 are permanently maintained captive between the shoulder 92 on the wall 90 of the upper spray arm section 100 and the wall surface 70 on the lower spray arm section 102. The result is that no further assembly is required to operatively interconnect the towers 58, 60, 62 and spray arm 27, and the resulting assembly 10 can be in turn connected as an operable unit to the fluid conduit 32 projecting up through the pedestal 30.

The nut 96 is used to attach the spray arm assembly 10 to the conduit 32. The nut 96 surrounds the outer surface 112 of the tower receptacle 104 and has threads 114 to engage threads 116 on the conduit 32. Before the nut 96 is threaded onto the conduit 32, the split ring 99 is put in place. The configuration of suitable split ring 99 and its relationship to the remainder of the spray arm assembly 10 and pedestal 30 are described fully in U.S. Pat. No. 4,732,323, assigned to Whirlpool Corporation.

The support sleeve subassembly 98 has a sleeve 117 that is generally cup-shaped and has an enlarged, radially extending flange 118 at the top thereof. The body 120 of the sleeve 117 surrounds the tower receptacle 104 on the lower spray arm section 102 and nests in an undercut 122 on the nut 96. With the uppermost surface 124 of the sleeve 117 abutting the downwardly facing annular shoulder 126 defined by the undercut 122, the bottom surface 128, defined cooperatively by the ribs 72 and hub 74, can be brought into close proximity with an upwardly facing surface 130 on the support sleeve 117, which surface 130 is defined cooperatively by a hub 132 and a plurality of ribs 134 extending radially from the hub 132. The bottom surface 128 on the spray arm 27 conforms closely in contour to the surface 130.

The support sleeve subassembly 98 further includes a washer 136, a shoulder screw 138 and a bearing 140, all of which are pre-assembled to the support sleeve 117. The shoulder screw 138 is directed upwardly consecutively through the bearing 140, a bore 142 in the support sleeve 117 and the washer 136, which maintains the shoulder screw 138 in place on the sleeve 117. After preassembly of the support sleeve subassembly 98 the shoulder screw 138 is directed into a threaded bore 144 in the hub 74 on the lower spray arm section 102. The lower spray arm section 102 and screw 138 rotate as a unit and the unthreaded portion 146 of the screw 138 is guided smoothly in rotation within the support sleeve bore 142. The washer 136, interposed between the hub 74 on the lower spray arm section 102 and the hub 132 on the support sleeve 117, maintains a slight spacing between the facing surfaces 128, 130 to thereby permit substantially uninhibited relative rotation between the lower spray arm section 102 and the support sleeve 117.

The support sleeve subassembly 98 is preferably preassembled with the remainder of the spray arm assembly 10 before the support sleeve 117 is put in place around the tower receptacle 104 and before the spray arm assembly 10 is attached to the pump conduit 32. Once assembly of the sleeve subassembly 98 has occurred, the sleeve 117 is directed into the bore 148 of the conduit 32. A close friction fit between the sleeve 117 and conduit 32 is enhanced by a plurality of circumferentially spaced, deformable ribs 150 on the sleeve 117, which ribs 150 are squeezed tightly between the body 120 of the sleeve 117 and the conduit surface surrounding the bore 148. With the sleeve 117 extended fully downwardly within the bore 148, a downwardly facing, annular surface 152 on the flange 118 bears on the free upper edge 154 of the conduit 32. The nut 96 is then threaded down onto the conduit 32 and in the process nut shoulder 126 bears down and positively presses the sleeve flange 118 against the conduit edge 154.

With the inventive structure, the sleeve subassembly 98 can be preassembled and thereafter connected to the lower spray arm section 102 to produce the self-contained spray arm assembly 10. The split ring 99 is captively maintained in operative position between the support sleeve subassembly 98 and the spray arm 27. The attachment of the sleeve 117 and nut 96 is carried out from one side of the spray arm assembly 10. That is, the nut 96 is extended upwardly over the receptacle 104 and in turn the sleeve subassembly 98 is directed upwardly over the receptacle 104 to complete assembly. An entire unit consisting of the spray arm 27, the tower 28, the split ring 99, the nut 96, and sleeve subassembly 98 can be put in place on the pedestal 30 and removed therefrom simply by selectively tightening and loosening the retaining nut 96.

The foregoing disclosure of specific embodiments is intended to be illustrative of the broad concepts comprehended by the invention.

We claim:

1. A spray arm assembly for delivering fluid under pressure into a dishwasher wash chamber, said spray arm assembly comprising:

a spray arm having a rotational axis and defining a fluid passageway for distributing fluid from a pressurized supply into a wash chamber;

a tower section;

means for mounting the tower section to the spray arm for guided movement relative to the spray arm between a retracted position and an extended position; and means on the tower section for directing fluid from a pressurized supply into a wash chamber with the tower in its extended position, said mounting means further including means integrally and permanently formed with the spray arm for preventing the tower section from separating from the spray arm, whereby the spray arm and tower section are permanently and inseparably assembled, said mounting means comprising a wall integrally formed as one piece with the spray arm, said wall defining a shoulder which abuts a part of the tower section to thereby hold the tower section in its extended position and prevent separation of the tower section from the spray arm.

2. The spray arm assembly according to claim 1 wherein there is a lip on the tower section to abut the shoulder with the tower section in its extended position to prevent the tower section from moving relative to the spray arm from said retracted position past and extended position.

3. The spray arm assembly according to claim 2 wherein said spray arm has a bottom wall integrally formed therewith, facing upwardly and bearing on the tower section to support the tower section in its retracted position.

4. A spray arm assembly for delivering fluid under pressure into a dishwasher wash chamber, said spray arm assembly comprising:

a spray arm having a rotational axis and defining a fluid passageway for distributing fluid from a pressurized supply into a wash chamber;

a tower section;

means for mounting the tower section to the spray arm for guided movement relative to the spray arm between a retracted position and an extended position;

means on the tower section for directing fluid from a pressurized supply into a wash chamber with the tower section in its extended position;

a support sleeve and a nut for connection of the support sleeve to a fluid pump;

means accessible from beneath the spray arm for attaching the support sleeve to the spray arm; and cooperating means on the support sleeve, spray arm and nut for maintaining the nut captively between the spray arm and support sleeve with the support sleeve attached to the spray arm, said mounting means further including means for preventing the tower section from separating from the spray arm with the tower section in its extended position.

5. The spray arm assembly according to claim 1 in combination with a support sleeve, means for attaching the support sleeve to the spray arm, a sealing ring and cooperating means on the support sleeve and spray arm for maintaining the sealing ring in operative position wherein the sealing ring blocks passage of fluid between the spray arm and support sleeve.

6. The spray arm assembly according to claim 4 wherein said support sleeve attaching means includes a screw which is directed through the support sleeve upwardly into the arm.

7. The spray arm assembly according to claim 4 wherein said support sleeve, attaching means and nut are assembled to the spray arm from one direction.

8. The spray arm assembly according to claim 4 wherein said attaching means comprises a screw and means are provided for preassembling the screw and support sleeve to provide a subassembly that can be attached as a unit to the spray arm.

9. The spray arm assembly according to claim 8 wherein said subassembly includes a bearing interposed between the screw and support sleeve.

10. The spray arm assembly according to claim 1 wherein a plurality of tower sections are provided, and means are provided for telescopingly mating the plurality of tower sections.

11. A spray arm assembly for delivering fluid under pressure into a dishwasher wash chamber, said spray arm assembly comprising:

a spray arm having a rotational axis, defining a fluid passageway for distributing fluid from a pressurized supply into a wash chamber and defined by at least two permanently fused spray arm sections;

a tower section;

means for mounting the tower section to the spray arm for guided movement relative to the spray arm between a retracted position and an extended position; and means on the tower section for directing fluid from a pressurized fluid supply into the wash chamber with the tower in its extended position, said mounting means further including cooperating means on the tower section and spray arm for preventing the tower section from separating from the spray arm said cooperating means comprising a wall integrally formed as one piece with the spray arm, said wall defining a shoulder which abuts a part of the tower section to thereby hold the tower section in its extended position and prevent separation of the tower section from the spray arm.

12. The spray arm assembly according to claim 11 wherein said two spray arm sections are made of plastic where they are fused.

13. A spray arm assembly for delivering fluid under pressure into a dishwasher wash chamber, said spray arm assembly comprising:

a spray arm having a rotational axis, defining a fluid passageway for distributing fluid from a pressurized supply into a wash chamber, defined by at least two joined spray arm sections and having a top and bottom;

a tower section;

means for mounting the tower section to the spray arm for guided movement relative to the spray arm between a retracted position and an extended position;

means on the tower section for directing fluid from a pressurized fluid supply into the wash chamber with the tower in its extended position, said mounting means further including cooperating means on the tower section and two fused spray arm sections for preventing the tower section from separating from the spray arm;

a support sleeve for connection to a fluid pump; and means accessible only from beneath the spray arm for removably connecting the support sleeve and spray arm together for relative rotation.

14. A spray arm assembly for delivering fluid under pressure into a dishwasher wash chamber, said spray arm assembly comprising:

a spray arm having a top and bottom and a rotational axis and defining a fluid passageway for distributing fluid from a pressurized supply into a wash chamber;

a tower section;

means for mounting the tower section to the spray arm for guided movement relative to the spray arm between a retracted position and an extended position;

means on the tower section for directing fluid from a pressurized fluid supply into the wash chamber with the tower in its extended position, said mounting means further including cooperating means on the tower section and spray arm sections for preventing the tower section from separating from the spray arm;

a support sleeve for connecting to a fluid pump; and means accessible only from beneath the spray arm for removably connecting the support sleeve and spray arm together for relative rotation.

* * * * *